US009879383B2

(12) United States Patent
Lutter

(10) Patent No.: US 9,879,383 B2
(45) Date of Patent: Jan. 30, 2018

(54) RAIL FASTENER AND ARRANGEMENT COMPRISING SUCH A RAIL FASTENER

(71) Applicant: Heico Befestigungstechnik GmbH, Ense-Niederense (DE)

(72) Inventor: Frank Lutter, Welver-Stocklarn (DE)

(73) Assignee: HEICO BEFESTIGUNGSTECHNIK GMBH, Ense-Niederense (DE)

( * ) Notice: Subject to any disclaimer, the term of this patent is extended or adjusted under 35 U.S.C. 154(b) by 158 days.

(21) Appl. No.: 15/023,765

(22) PCT Filed: Sep. 26, 2013

(86) PCT No.: PCT/EP2013/070109
§ 371 (c)(1),
(2) Date: Mar. 22, 2016

(87) PCT Pub. No.: WO2015/043643
PCT Pub. Date: Apr. 2, 2015

(65) Prior Publication Data
US 2016/0230351 A1 Aug. 11, 2016

(51) Int. Cl.
*E01B 9/10* (2006.01)

(52) U.S. Cl.
CPC ..... *E01B 9/10* (2013.01)

(58) Field of Classification Search
CPC ..... E01B 9/00; E01B 9/02; E01B 9/04; E01B 9/06; E01B 9/08; E01B 9/10; E01B 9/12; E01B 9/14; E01B 9/16; E01B 9/20
See application file for complete search history.

(56) References Cited

U.S. PATENT DOCUMENTS 4,907,740 A * 3/1990 Oberweiler ..... E01B 9/303 238/283
6,257,495 B1 * 7/2001 Eisenberg ..... E01B 9/303 238/349

(Continued)

FOREIGN PATENT DOCUMENTS

DE 202008014249 U1 12/2008
FR 1521504 A 4/1968
FR 2315568 A1 1/1977

OTHER PUBLICATIONS

International Preliminary Report on Patentability, Chapter I, for parent case PCT/EP2013/070109, dated Mar. 29, 2016.

(Continued)

*Primary Examiner* — Jason C Smith
(74) *Attorney, Agent, or Firm* — Polson Intellectual Property Law, PC; Margaret Polson

(57) ABSTRACT

A rail fastener (7) comprises an anchoring shaft (9) for fixing the rail fastener (7) in a fastening base, for instance a sleeper (2) which bears the rail (1), and a head (10) which is integrally formed on the anchoring shaft (9) and equipped with means for receiving a torque for the purpose of screwing the anchoring shaft (9) into the fastening base. The rail fastener (7) is distinguished in that—a threaded shaft (11) is integrally formed on the head (10) on the side thereof opposite to the anchoring shaft (9) or a bore equipped with an internal thread is made in the head (10) and/or the anchoring shaft (9) integrally formed thereon from the side thereof opposite to the anchoring shaft (9), —the head (7) has a surface portion as a first abutment surface (24) annularly surrounding the threaded shaft (11) or the threaded bore, —the rail fastener (7) has a clamping element (12) seated on the threaded shaft (11) or engaging in the internal thread of the head (10) and/or of the anchoring shaft (9) and meshing with the respective thread, which clamping element (Continued)

has an outwardly projecting projection for supporting on at least one leg of a rail hold-down spring (22) and a shaft portion (15) integrally formed thereon in the direction of the head (10), which shaft portion has a second abutment surface (26) directed towards the head (10) and corresponding with the first abutment surface (24) and—between the two abutment surfaces (24, 26) there is situated a securing disc or a securing disc arrangement (16) which is supported on the abutment surfaces (24, 26) to prevent the clamping element (12) from loosening.

16 Claims, 4 Drawing Sheets

(56) References Cited

U.S. PATENT DOCUMENTS 6,318,939 B1 * 11/2001 Avaux ..... E01B 9/10 411/153
6,350,093 B1 * 2/2002 Petersen ..... F16B 33/002 411/178
7,854,392 B2 * 12/2010 Hauschild ..... E01B 9/28 238/349
7,992,798 B2 * 8/2011 Bosterling ..... E01B 9/483 238/310
9,290,888 B2 * 3/2016 Lienhard ..... E01B 9/303
2003/0111543 A1 * 6/2003 Oram ..... E01B 9/06 238/29
2004/0232254 A1 * 11/2004 Kowalski ..... E01B 1/004 238/264
2005/0269421 A1 * 12/2005 Sargis ..... E01B 9/10 238/366
2008/0257972 A1 * 10/2008 Vorderbruck ..... E01B 9/303 238/331
2013/0015256 A1 * 1/2013 Bednarczyk ..... E01B 9/02 238/315
2013/0206854 A1 * 8/2013 Bosterling ..... E01B 9/303 238/287
2013/0284819 A1 * 10/2013 Ortmann ..... E01B 9/303 238/264
2014/0371373 A1 * 12/2014 Harrass ..... B29C 45/46 524/494
2015/0033663 A1 * 2/2015 Kunz ..... E01B 1/007 52/704
2015/0252836 A1 * 9/2015 Sargis ..... F16B 39/28 411/411
2016/0017545 A1 * 1/2016 Bosterling ..... E01B 9/02 238/291
2016/0230351 A1 * 8/2016 Lutter ..... E01B 9/10

OTHER PUBLICATIONS

Written Opinion of the International Searching Authority for parent case PCT/EP2013/070109, dated May 19, 2014.
International Search Report for parent case PCT/EP2013/070109, dated May 19, 2014.

* cited by examiner

RAIL FASTENER AND ARRANGEMENT COMPRISING SUCH A RAIL FASTENER

BACKGROUND

The invention relates to a rail fastener comprising an anchoring shaft for securing the rail fastener in a fastening base (e.g., a railroad tie) which supports a rail, and a head which is integrally molded on the anchoring shaft and is configured to receive a torque for the purpose of screwing the anchoring shaft into the fastening base. Furthermore, the invention relates to a rail fastening arrangement having such a rail fastener.

Rails for trains are laid on railroad ties. The rails themselves have a mounting flange which sits on the top side of the railroad tie. The rails are fastened to the railroad ties by means of rail fasteners. The rail fasteners are secured by an anchoring shaft in the railroad tie next to the rail. A rail hold-down spring serves to hold the rail, the spring being bent essentially in a U shape with its section connecting the two legs protruding beyond the mounting flange of the rail opposite the rail head and being braced against the flange by the rail fastener. Such a rail fastener comprises the anchoring shaft mentioned above and a head integrally mounted thereon. The head is designed as a polygonal head, so that a torque can be applied by a tool to secure it. A collar is formed on the bottom side of the head to provide a sufficiently protruding edge, which acts on the top side of the leg of the hold-down spring. A flexible rail fastening is necessary to equalize movement between the rail and the railroad tie. The hold-down spring serves this purpose. With this type of rail fastener already known in the art, the fastener is secured by screwing the anchoring shaft into the fastening base, and at the same time the hold-down spring is stressed against the mounting flange of the rail. If the railroad ties are precast concrete components, they are equipped with dowels inserted into prefabricated fastening boreholes, so that the anchoring shaft engages in such a dowel for securing it. The dowels used are preferably plastic dowels.

Such rail fasteners are in use throughout the world. However, because of movement occurring between the rail and the railroad tie, the rail fasteners have the disadvantage of requiring to be inspected at regular intervals with respect to how well the rail is anchored. It is often necessary to retighten the rail fastener. To ensure safe railway operation, regular inspections of the rail fastening must usually be performed several times a year.

SUMMARY

Against this background, the invention relates to a rail fastener and a rail fastening arrangement which can assure that loosening of the rail anchoring is effectively prevented even on segments that are under stress. This is achieved by a rail fastener in which

- a connecting means is located on the head opposite the anchoring shaft, such connecting means may be embodied as a threaded shaft integrally molded on the head on its side opposite the anchoring shaft or a bore furnished with an internal thread created in the head and/or the anchoring shaft integrally molded thereon from its side opposite the anchoring shaft,
- the head has a surface section as a first abutment surface annularly surrounding the connecting means (i.e., a threaded shaft and/or the threaded bore),
- the rail fastener has a clamping element, the clamping element engaging with the connecting means, for example, seated on the threaded shaft and/or engaged in the inside thread of the head and/or of the anchoring shaft and such that it interfaces with the respective thread, this clamping element having a protrusion extending outward for support of at least one leg of a rail hold-down spring and having a shaft section integrally molded thereon and facing in the direction of the head with a second abutment surface facing toward the head and corresponding to the first abutment surface, and
- at least one securing disk or securing disk arrangement between the two abutment surfaces, which is supported on the abutment surfaces to prevent the clamping element from loosening.

With this rail fastener, for the first time a separation has been achieved between the functionalities of "anchoring in the fastening base" and "prestressing the hold-down spring." This means that tightening of the anchoring shaft in the fastening base (e.g., in a railroad tie) is decoupled with respect to the torque applied from the force with which the hold-down spring is prestressed to the mounting flange of the rail. The hold-down spring is clamped between the head of the rail fastener and a clamping element cooperating with it. The clamping element, for example, may be embodied as a nut. With such an embodiment, a complementary threaded shaft is formed on the side of the head opposite the anchoring shaft. According to another embodiment, it is provided that the clamping element is designed as a screw body with a threaded shaft, which engages the connecting means, in this case a bore having a complementary internal thread created in the head and/or the anchoring shaft of the rail fastener. With this rail fastener, the clamping element can be clamped with respect to the head. For loosening these two elements which are essential for fastening of the rail as intended, it is provided that the facing surfaces of these elements each form or have an abutment surface and a securing disk or securing disk arrangement provided between the abutment surfaces. As a result of this functional separation, a torque can be applied between these two parts—the clamping element and the head—with the securing disk or securing disk arrangement inserted in between, such that an effective loosening is provided. It is essential that the torque to be applied in this regard is not introduced into the anchoring shaft. For this reason, differently designed anchorings of the anchoring shaft may be provided. If the anchoring shaft is a bolt provided with an outside thread, then plastic dowels are sufficient for an effective and long-lasting anchoring of the anchoring shaft in the fastening base. It is also possible to provide for the anchoring shaft to be cast directly in the railroad tie, which is manufactured as a precast concrete component. With such an embodiment, the anchoring shaft may have one or more interlocking elements protruding in the radial direction.

The rail fastener described above can be used on various fastening bases. For example, the base may be designed as a railroad tie. If, within the scope of these embodiments, reference is made to a railroad tie as a fastening base, then this includes any rail support on which the rail to be fastened rests. Embodiments where the fastening base is a concrete plate, which serves to receive and introduce the expected weight into the substrate, are possible. With such a design, thin rail supports made of plastic may also be provided on the concrete plate with the rails resting on them. In this design, the anchoring shaft passes through such a rail support and is ultimately secured in the concrete plate as an anchoring base.

The torque applied to induce a loosening between the clamping element and the head molded on the anchoring shaft depends on the choice of the securing disk or securing disk arrangement inserted between the abutment surfaces. To be able to apply the torque required for clamping the clamping element with respect to the head with the insertion of the securing disk or securing disk arrangement without having to hold the head of the rail fastener, so that it is actively prevented from twisting, it is provided in one embodiment of a rail fastening arrangement that the head is clamped with its underside against the top side of the fastening base. In addition or alternatively, a twist preventing device may be inserted for rotationally securing the head of the rail fastener. Such a twist preventing device is typically supported with a supporting surface on the longitudinal extent of the rail to be held and is thereby itself prevented from twisting. With one or more other surfaces, the twist preventing device is in contact with the outside of the head of the rail fastener, which is typically embodied as a polygonal shape.

With the design described above, it is also possible for the clamping element to be clamped with respect to the head with a higher torque than the torque with which the anchoring shaft of the rail fastener is secured in the railroad tie.

To ensure that loosening between the clamping element and the head of the rail fastener will be prevented, a securing disk may be arranged between the abutment surfaces, which exerts a prestress on the abutment surfaces. These disks are supported with their interlocking structures on one or both abutment surfaces, depending on the design of the disk. The securing disk may be a spring or toothed disk.

According to one embodiment, instead of such a securing disk, a securing disk arrangement is provided for, such as a pair of wedge securing disks in which loosening is prevented by the set clamping force and not by friction. Those skilled in the art are familiar with such wedge securing disks and/or pairs of wedge securing disks. On their sides facing one another, these wedge securing disks have wedge ribs that are inclined by a certain angle. Radial ribs, typically having a saw tooth design, are arranged on the sides facing away from one another for interlocking and cooperate with the respective abutment surface of the clamping element and/or the head. The wedge surface angle of the wedge surfaces of the wedge ribs of these disks is larger than the angle of pitch of the screw thread used to create the prestress. Spontaneous loosening of the clamping element with respect to the head and other components of the rail fastener is effectively prevented with such a pair of securing disks. According to one modification of such a locking mechanism, one of the two wedge securing disks is part of the clamping element and is even integrally molded thereon. Thus, with such a design, the wedge surfaces and/or the wedge ribs are integrally molded on the clamping element and form the abutment surface in this regard. The other wedge securing disk, which is loose in relation to this disk, faces toward the abutment surface of the head with its radial ribs and toward the web ribs of the clamping element with its wedge ribs.

According to another embodiment, for the purpose of preventing twisting of the head in clamping of the clamping element with respect to the head, an additional twist preventing element is provided. This may be an injection-molded plastic part, for example. It may also be made of some other material such as metal. According to a preferred embodiment, such a twist preventing element has a receptacle for receiving the head of the rail fastener in a torque-locking manner. With such an embodiment, the head of the rail fastener is not designed to be rotationally symmetrical. Typically a polygonal head is provided, for example a square head. If the head of the rail fastener is inserted into this receptacle, it is held therein in a torque-locking manner. The twist preventing element itself is held in a twist preventing manner with respect to the fastening base, such as a railroad tie, by the contact surface already described above so that this contact surface comes to rest against the outside of the mounting flange of the rail. A means for twist-locking this twist-locking element can also be provided with respect to the railroad tie itself, for example, by straps in contact with one or both side surfaces of the railroad tie.

In a refinement of such a twist-locking element, it is provided that the receptacle for receiving the head of the rail fastener is covered at least partially at the top, so that the cover rests on the top side of the head. The hold-down spring held by such a rail fastener is typically supported at its spring ends on the side of the twist-locking element. In one such embodiment, the torque applied via the clamping element is then introduced into the twist-locking element over a large area.

In one embodiment, it is provided that the bottom side of the head—the side facing in the direction of the anchoring shaft—has interlocking structures, which are designed to cooperate with complementary interlocking structures on the top side of the rail or an element placed on the railroad tie to prevent any twisting. With such an embodiment, the rail fastener is cast in the fastening base instead of being screwed into it.

BRIEF DESCRIPTION OF THE DRAWINGS

Additional advantages and embodiments of the invention are derived from the following description with reference to the accompanying figures.

DETAILED DESCRIPTION

Figure 1:
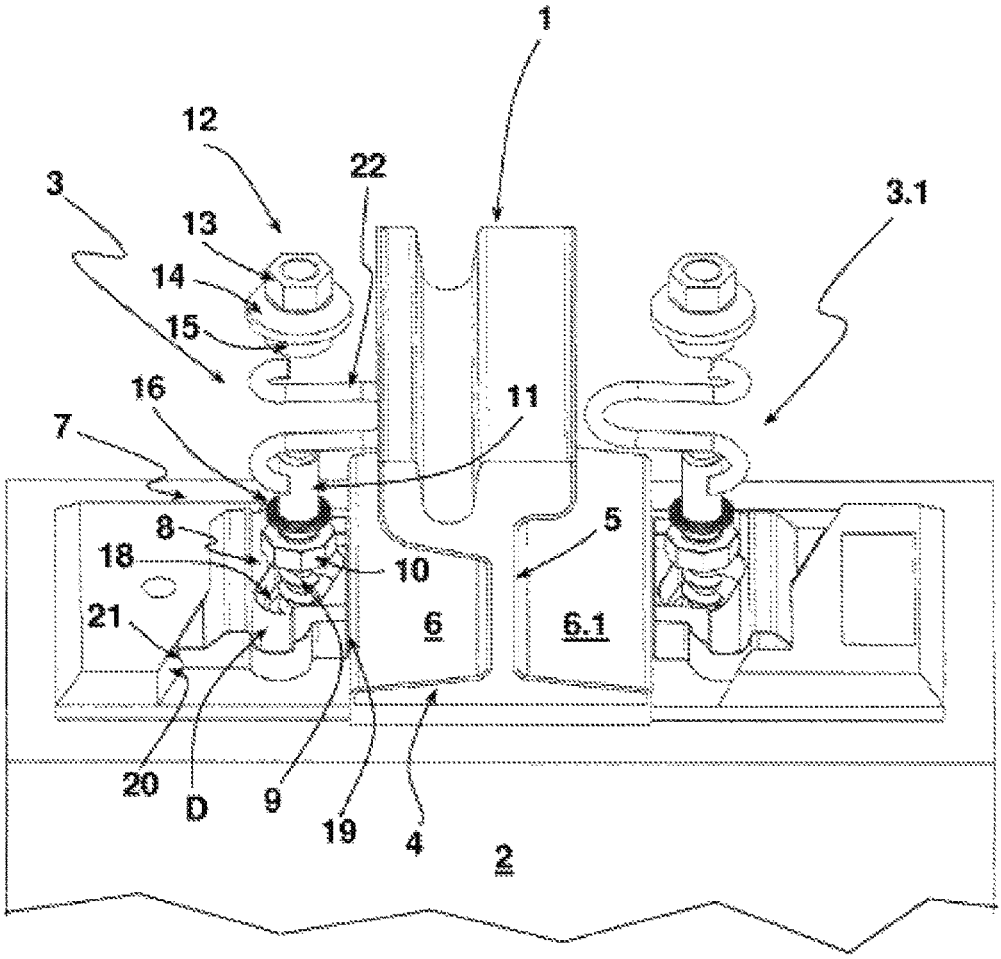
FIG. 1 shows a perspective view of a rail fastening arrangement in an exploded diagram.

FIG. 1 shows a rail section schematically in a perspective view. A rail 1, which is embodied as a grooved rail in this embodiment, is placed on a railroad tie 2 and carried by the tie. The rail 1 is connected to the railroad tie 2 by means of two rail fastening arrangements 3, 3.1, wherein each rail fastening arrangement 3, 3.1 is arranged on one side of the rail. Thus, the rail 1 is surrounded by the rail fastening arrangement 3, 3.1. The rail 1 has a mounting flange 4 on its end opposite the rail head, this flange protruding on both sides of the rail web 5. The top sides 6, 6.1 of the mounting flange 4 serve as the working surface for securing the rail 1 on the railroad tie 2. The rail fastening arrangements 3, 3.1 are all of the same design here. The rail fastening arrangement 3 is described in greater detail below. The discussion in this regard is equally true for the rail fastening arrangement 3.1.

The core item of the rail fastening arrangement 3 is a rail fastener 7. The rail fastener 7 of the embodiment shown comprises three modules. The first module is an anchoring module 8 which is manufactured in one piece and comprises an anchoring shaft 9 equipped with a grooved outside thread for engaging in a dowel inserted into a fastening bore in the railroad tie 2. A polygonal head 10 is integrally molded on the anchoring shaft 9. The head 10 protrudes beyond the anchoring shaft 9 and has dimensions such that its diameter is greater than the diameter of the bore created in the railroad tie 2 in which the anchoring shaft 9 engages. A connecting means 11, which is a threaded shaft 11 in this embodiment, is integrally molded on the top side of the head 10. The second anchoring module is implemented by a clamping element 12. In the embodiment shown here, the clamping element 12 is formed by a nut 13, a collar 14 integrally molded on the bottom side thereof for providing a protrusion on which the hold-down spring is in contact with a section, and a sleeve-type shaft section 15, which is in turn integrally molded thereon.

The third anchoring module in the embodiment shown is formed by a pair of wedge securing disks 16, discussed in more detail below.

In addition, a twist preventing device D manufactured as an injection molded plastic part may be included in the rail fastening arrangement 3. The twist preventing device D has a receptacle 18 to receive the head 10. The receptacle 18 is designed as an elongated hole in this embodiment, and the longitudinal axis of the receptacle 18 runs at an acute angle to the longitudinal extent of the rail 1. The inside clearance of the receptacle 18 (transverse width) corresponds to the distance between two surfaces of the head 10 of the rail fastener 7 which are diametrically opposed to the longitudinal axis. Thus, the rail fastener 7 is held in a torque-locking manner when the head 10 engages in the receptacle 18 in the twist preventing device D. The twist preventing device D has a contact surface 19, which follows the longitudinal extent of the exterior of the mounting flange 4. In parallel with the longitudinal extent of the receptacle 18, the railroad tie 2 has a contact surface 20 running vertically at the top. A second contact surface 21 of the twist preventing device D is in contact with the latter. The longitudinal axis of the receptacle 18, which is inclined with respect to the longitudinal extent of the rail 1 as well as the contact surfaces 20, 21 running parallel thereto, serves the purpose of setting up the twist preventing device D with respect to its distance from the rail 1. The twist preventing device D is itself held in a locked manner due to the contact surfaces described above.

A rail hold-down spring 22 of an essentially known type serves to hold the rail 1 on the railroad tie 2. For this purpose, the rail hold-down spring 22 is designed essentially in a U shape, wherein the section connecting the legs is clamped for holding the rail 1 on the side 6 of the mounting flange 4.

Figure 2:
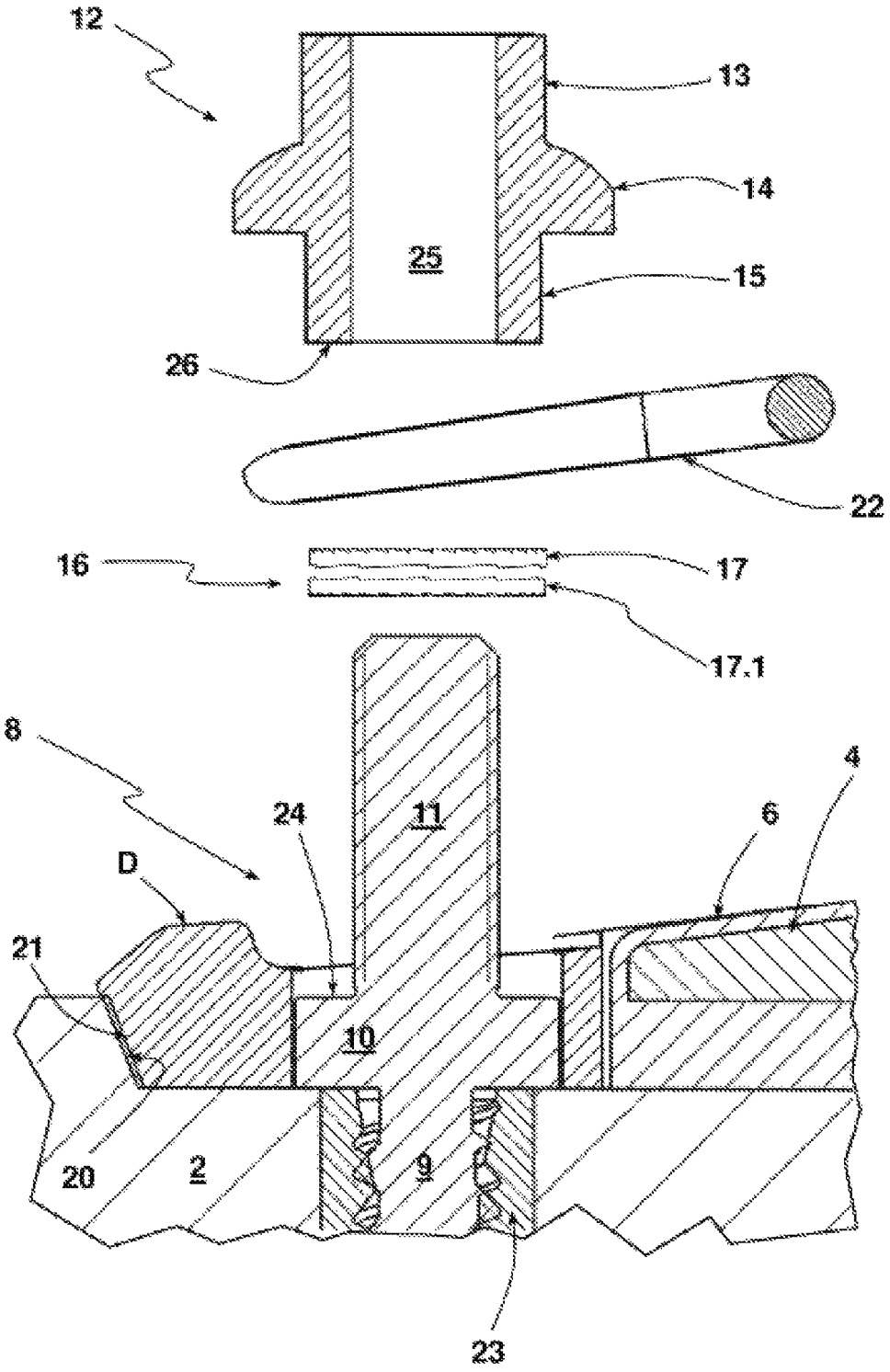
FIG. 2 shows a longitudinal sectional view through the left side of the left portion of the rail fastener of FIG. 1 in an exploded diagram.

The design of the rail fastener 3 with its two anchoring modules 8, 16 and with the clamping element 12 as the third anchoring module is shown in a longitudinal section in FIG. 2. Additional details can be derived here. In FIG. 2, the anchoring module 8 is anchored with its screw shaft 9 in a plastic dowel 23 inserted into the railroad tie 2. This was done before the twist preventing device D was put in place. The anchoring module 8 is screwed in by way of a torque transmitting tool attached to or onto the head 10. The head 10 protrudes beyond the diameter of the bore receiving the dowel 23, as shown clearly in the sectional diagram in FIG. 2. Consequently, the underside of the head 10 is offset with respect to the top side of the railroad tie 2. When the anchoring module 8 is secured in the railroad tie 2, the twist preventing device D is attached. In this diagram, it can also be seen that the contact surfaces 20, 21 working together are inclined with respect to the perpendicular.

Surrounding the root of the connecting means 11, embodied as the threaded shaft 11 here, the top side of the head 10 forms a first abutment surface 24. The abutment surface 24 is designed in the form of a ring.

The clamping element 12 may be designed in the manner of a sleeve, which has an inner passage 25 with an inside thread that is complementary to the thread of the connecting means being a threaded shaft 11 here. A hexagon is integrally molded on the outside in the section of the nut 13. This serves to attach the torque-transmitting tool for tightening the clamping element 12 with respect to the first anchoring module 8 and/or the head 10. The end face of the clamping element 12 facing the anchoring module 8 forms a second annular abutment surface 26, which is flush with the abutment surface 24 of the head 10. The abutment surfaces 24, 26 serve the purpose that the sides of the pair of wedge securing disks 16 facing away from one another can be supported on them. The pair of wedge securing disks, such as the pair of wedge securing disks 16, is known in the art, such as the ones distributed under the brand name HEICO-LOCK® from HEICO Befestigungstechnik GmbH, just for an example. The two securing disks 17, 17.1 of the pair of wedge securing disks 16 are arranged relative to one another as intended, i.e., the wedge ribs having the wedge surfaces that provide the securing effect face one another, while the surfaces having radial ribs face away from each other to each face an abutment surface 24 and/or 26. The radial ribs serve to interlock with the respective abutment surface 24 and/or 26. The angle of inclination of the wedge surfaces of the securing disks is greater that the angle of slope of the screw thread of the threaded shaft 11. With the rail fastener 3 installed, the clamping element 12 is clamped with respect to the head 10, with this pair of securing disks 16 inserted in between. This clamping is accomplished with a predetermined torque, the clamping force with which the wedge surfaces that are in contact with one another are also in contact with the wedge securing disks 17, 17.1 for the purpose of preventing loosening as desired. The radial ribs arranged on the sides facing away from one another have a sawtooth design, such that the steeper flank faces away from the respective loosening movement.

Figure 3:
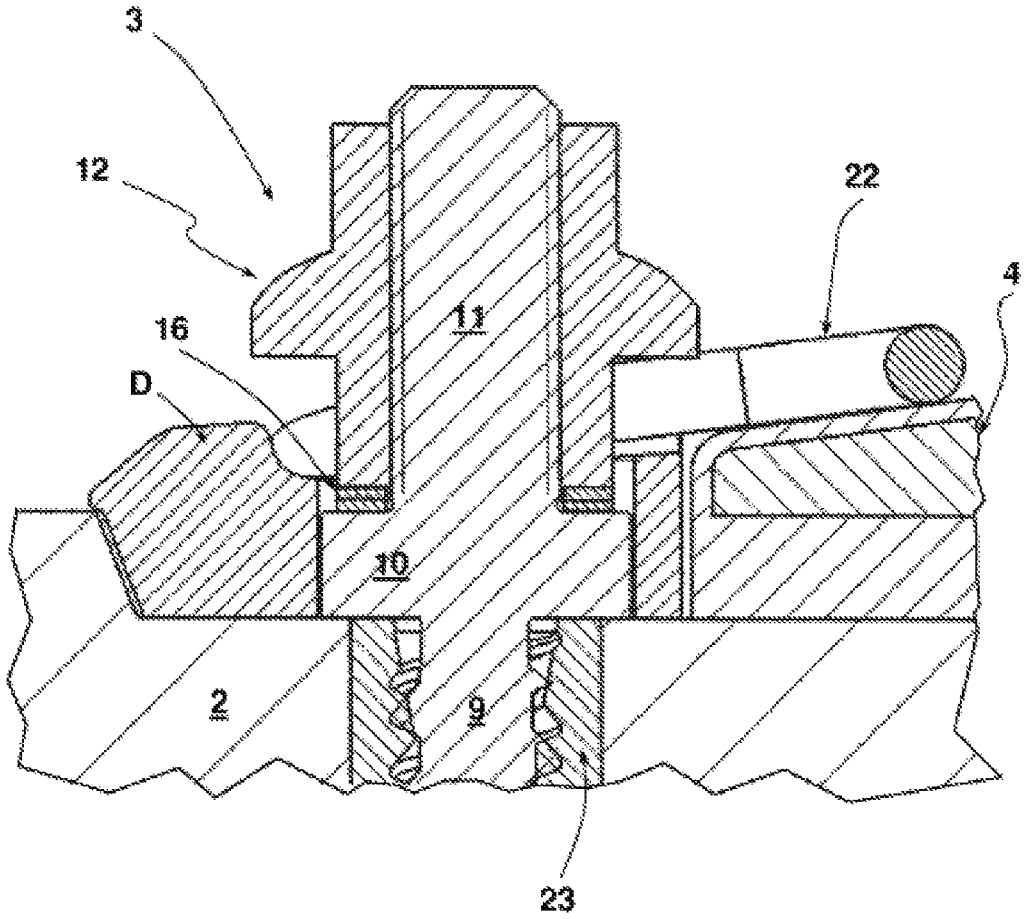
FIG. 3 shows the rail fastener from FIG. 2 in its arrangement holding a rail without explosion.

FIG. 3 shows the rail fastener 3 in the arrangement of its individual parts pressing the rail hold-down spring 22 against the top side 6 of the mounting flange 4 of the rail 1 as intended. As already described with regard to FIG. 2, the anchoring module 8 was anchored in the railroad tie 2. Then the pair of wedge securing disks 16 was first placed on the threaded shaft 11, wherein the wedge securing disk 17.1 was in contact with the abutment surface 24 with its side having the radial ribs. Then the hold-down spring 22 was inserted and the clamping element 12 was threaded onto the threaded shaft 11. Using a suitable tool, the clamping element 12 is screwed down and clamped with respect to the head 10 of the anchoring module 8—which is held in a twist preventing manner by the twist-locking element D—with the clamping force required for clamping the two securing disks 17, 17.1. Since the anchoring module 8 and/or the head 10 is held in a twist preventing manner, this clamping force is not introduced into the anchoring shaft 9 and the dowel 23. Meanwhile, inexpensive plastic dowels, which need not be able to withstand the significantly higher clamping forces for clamping the securing disks 17, 17.1 against one another, can be used for anchoring the anchoring module 8 as intended. Thus, a functional separation between the anchoring of the rail fastener in the railroad tie and for applying the required clamping force for holding down the hold-down spring is effectively achieved, while simultaneously providing a particularly effective means of preventing loosening, embodied as an intermediate pair of wedge securing disks 16 here.

Figure 4:
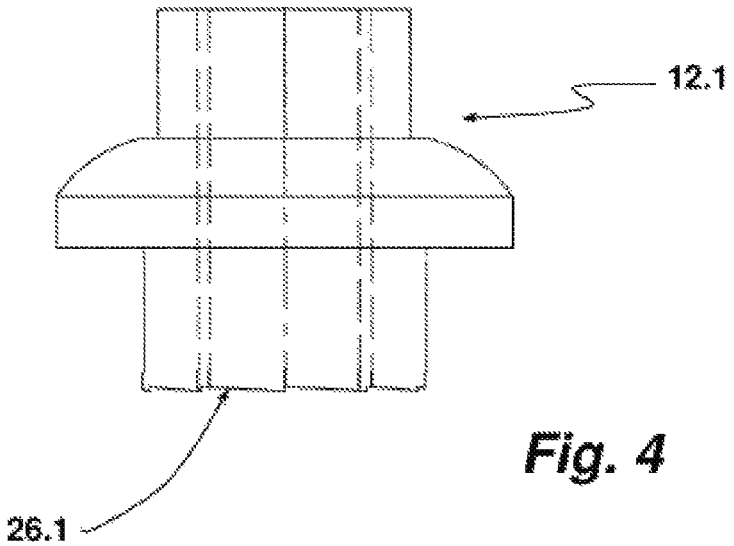
FIG. 4 shows a side view of the clamping element of a rail fastener according to another embodiment.

FIG. 4 shows a clamping element 12.1 according to another embodiment. The abutment surface 26.1 of the clamping element 12.1 is formed by a wedge rib arrangement as described in the embodiment above as part of the wedge securing disk 17. In such a design, only one wedge securing disk is inserted between the clamping element 12.1 and the head of the anchoring module 8. The disk is inserted in an orientation such that the wedge surfaces and wedge ribs that are complementary to the abutment surface 26.1 of the clamping element 12.1 face the clamping element 12.1.

Figure 5:
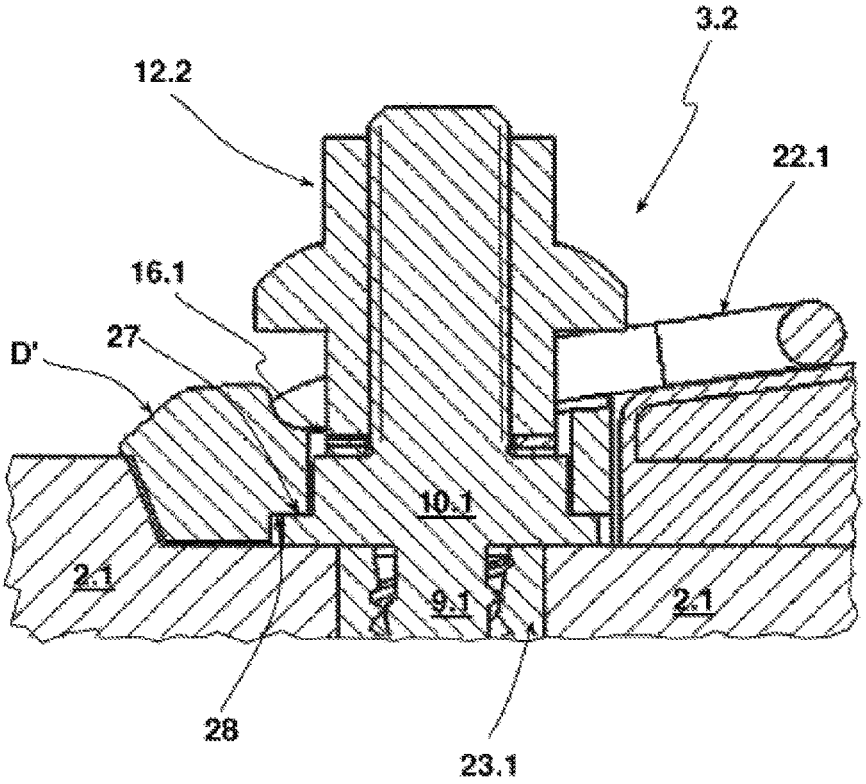
FIG. 5 shows a modified embodiment of the rail fastener of FIG. 3 from the same view.

In a modified embodiment, FIG. 5 shows a rail fastening arrangement 3.2 similar to that already described with reference to FIGS. 1 to 3. Therefore, the preceding discussion about the embodiment according to FIGS. 1 to 3 also applies accordingly to the rail fastening arrangement 3.2 of the embodiment of FIG. 5, unless the contrary is indicated below.

In the rail fastening arrangement 3.2, the twist preventing device D' is in cooperation with the head 10.1, such that the clamping force acting on the hold-down spring 22.1 also acts on the head 10.1 because the head 10.1 is supported on its top side by twist preventing device D'. FIG. 5 shows one possible embodiment of the implementation of such a concept. To this end, the head 10.1 has a peripheral shoulder 27 with a contact surface facing away from the anchoring shaft 9.1. The twist preventing device D' is designed to be complementary to the head 10.1. It has a complementary shoulder 28 facing in the direction of the shoulder 27. With this design, a slight gap (not visible in FIG. 5) is provided between the bottom side of the twist preventing device D' and the top side of the railroad tie 2.1. In this embodiment, the clamping force acting on the hold-down spring 22.1 thus acts on the top side of the twist preventing device D' due to the clamping of the clamping element 12.2 with respect to the head 10.1, with the pair of securing disks 16.1 in between as a result of the support of the hold-down spring 22.1, and also acts on the head 10.1 due to the arrangement of the contact of the shoulders 27, 28 described above. The clamping force for clamping the clamping element 12.2 with respect to the head 10.1 via the hold-down spring 22.1 therefore also causes a twist locking effect on the head 10.1, which is nevertheless clamped with respect to the top side of the railroad tie 2.1. This serves to relieve the load of forces acting on the dowel 23.1 via the anchoring shaft 10.1. Such a rail fastener can therefore also be used when the anchoring shaft is merely cast in the fastening base, for example, such as with an epoxy resin.

The invention claimed is:

1. A rail fastener comprising:

an anchoring shaft for securing the rail fastener in a fastening base, the fastening base supporting a rail;

a head integrally molded on the anchoring shaft and configured to receive a torque for screwing the anchoring shaft into the fastening base, wherein:

a connecting means is located on the head opposite the anchoring shaft, the connecting means comprising a thread, and the head has a surface section annularly surrounding the connecting means as a first abutment surface;

a clamping element which engages the thread of the connecting means, the clamping element comprising:

a protrusion extending outward to support at least one leg of a rail hold-down spring, and a shaft section with a second abutment surface, the shaft section facing the head and corresponding to the first abutment surface; and at least one securing disk situated between the first abutment surface and the second abutment surface for preventing loosening of the clamping element.

2. The rail fastener of claim 1, wherein the connecting means is a threaded shaft integrally molded on the head opposite the anchoring shaft.

3. The rail fastener of claim 1, wherein the connecting means is a bore furnished with an inside thread created in the head opposite the anchoring shaft.

4. The rail fastener of claim 3, wherein the bore furnished with the inside thread extends through the head into the anchoring shaft.

5. The rail fastener of claim 1, wherein the at least one securing disk which exerts a prestress on the first abutment surface and the second abutment surface is a spring disk.

6. The rail fastener of claim 1, wherein the at least one securing disk which exerts a prestress on the first abutment surface and the second abutment surface is a toothed disk.

7. The rail fastener of claim 1, wherein the at least one securing disk is a pair of securing disks.

8. The rail fastener of claim 1, wherein the at least one securing disk is a wedge securing disk, the wedge securing disk comprising radial ribs which engage the first abutment surface of the head and wedge ribs which engage the second abutment surface of the clamping element, wherein the second abutment surface of the clamping element has complementary wedge ribs which correspond to the wedge ribs of the wedge securing disk.

9. The rail fastener of claim 1, the rail fastener further comprising a twist preventing device, the twist preventing device having at least one surface cooperating with at least one exterior surface of the head to prevent twisting of the head.

10. The rail fastener of claim 9, wherein the twist preventing device has a contact surface for contact with the rail.

11. The rail fastener of claim 9, wherein the twist preventing device has a receptacle for receiving the head in a torque locking manner.

12. The rail fastener of claim 9, wherein the twist preventing device has one or more shapes molded to receive one or more sections of the rail hold-down spring.

13. The rail fastener of claim 11, wherein the receptacle is designed to at least partially cover the head of the rail fastener.

14. A rail fastening arrangement comprising the rail fastener of claim 1, wherein:

the fastening base is a railroad tie, the railroad tie having a bore;

the anchoring shaft engages and is secured within the bore; and the head of the rail fastener protrudes beyond the bore and is clamped against a top side of the railroad tie.

15. The rail fastening arrangement of claim 14, wherein the railroad tie is a precast concrete component having a dowel, the dowel inserted into the bore to receive the anchoring shaft.

16. The rail fastening arrangement of claim 15, wherein the dowel is a plastic dowel.

* * * * *